US011235952B2

(12) United States Patent
Trouvain et al.

(10) Patent No.: US 11,235,952 B2
(45) Date of Patent: Feb. 1, 2022

(54) ELEVATOR CAR APRON

(71) Applicant: Otis Elevator Company, Farmington, CT (US)

(72) Inventors: Guillaume Trouvain, Gien (FR); Clement Schach, Orléans (FR); Gerard Sirigu, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 203 days.

(21) Appl. No.: 16/531,794

(22) Filed: Aug. 5, 2019

(65) Prior Publication Data

US 2020/0048047 A1 Feb. 13, 2020

(30) Foreign Application Priority Data

Aug. 10, 2018 (EP) ..... 18306101

(51) Int. Cl.

| | |
|---|---|
| ***B66B 13/24*** | (2006.01) |
| ***B66B 13/08*** | (2006.01) |
| ***B66B 13/12*** | (2006.01) |
| ***B66B 13/28*** | (2006.01) |
| ***B66B 13/30*** | (2006.01) |

(52) U.S. Cl.

CPC ..... *B66B 13/24* (2013.01); *B66B 13/08* (2013.01); *B66B 13/12* (2013.01); *B66B 13/285* (2013.01); *B66B 13/301* (2013.01)

(58) Field of Classification Search

CPC ..... B66B 13/285

See application file for complete search history.

(56) References Cited

U.S. PATENT DOCUMENTS 4,556,129 A 12/1985 Martin

FOREIGN PATENT DOCUMENTS

| | | | |
|---|---|---|---|
| CN | 1982195 | A | 6/2007 |
| CN | 201447287 | U | 5/2010 |
| CN | 102120542 | A | 7/2011 |
| CN | 104326320 | A | 2/2015 |
| CN | 204162218 | U | 2/2015 |
| CN | 105775949 | A | 7/2016 |
| CN | 207243213 | U | 4/2018 |
| CN | 108059063 | A | 5/2018 |
| DE | 10052459 | A1 | 5/2002 |

(Continued)

OTHER PUBLICATIONS

European Search Report for European Application No. 18306101.9, International Filing Date Aug. 10, 2018, dated Feb. 22, 2019, 9 pages.

*Primary Examiner* — Diem M Tran

(74) *Attorney, Agent, or Firm* — Cantor Colburn LLP

(57) ABSTRACT

Elevator systems are provided. The elevator systems include an elevator car movable along an elevator shaft having a pit floor and a shaft top, the elevator car having a car door lock arranged to enable opening of doors by a landing door lock mechanism when the elevator car is located at a landing and an elevator safety system. The elevator safety system includes a car door lock securing device arranged to prevent manual opening of the elevator car doors when in a first state and permits opening of the elevator car doors when in a second state and a car apron affixed to the car door sill and operable from a stowed state to a deployed state, wherein when the car apron transitions from the stowed state to the deployed state, the car door lock securing device is transitioned from the first state to the second state.

16 Claims, 7 Drawing Sheets

(56) References Cited

FOREIGN PATENT DOCUMENTS

| | | | |
|---|---|---|---|
| DE | 20202775 | U1 | 8/2002 |
| DE | 202006007666 | U1 | 10/2007 |
| DE | 102006045499 | A1 | 4/2008 |
| EP | 1215159 | A2 | 6/2002 |
| EP | 1524234 | A1 | 4/2005 |
| EP | 1772414 | A1 | 4/2007 |
| EP | 1854758 | A1 | 11/2007 |
| EP | 1914190 | A1 | 4/2008 |
| EP | 2039644 | A1 | 3/2009 |
| EP | 2042463 | A1 | 4/2009 |
| EP | 2581334 | B1 | 8/2016 |
| EP | 3257803 | A | 12/2017 |
| FR | 2841886 | A1 | 1/2004 |
| JP | H02305781 | A | 12/1990 |
| JP | 2007131446 | A | 5/2007 |
| WO | 02060802 | A2 | 8/2002 |
| WO | 2005121014 | A2 | 12/2005 |
| WO | 2005121015 | A2 | 12/2005 |
| WO | 2008074911 | A1 | 6/2008 |
| WO | 2013054321 | A1 | 4/2013 |
| WO | 2013057362 | A1 | 4/2013 |

ELEVATOR CAR APRON

CROSS REFERENCE TO RELATED APPLICATIONS

This application claims the benefit of European Application No. 18306101.9, filed Aug. 10, 2018, which is incorporated herein by reference in its entirety.

BACKGROUND

The subject matter disclosed herein generally relates to elevator systems and, more particularly, to elevator car aprons and safety mechanisms for elevator systems.

Traditional safety requirements for elevator shafts have led to larger spaces both at the top and bottom of the elevator shaft. However, such enlarged spaces may be disadvantageous for architectural reasons. Thus, elevator manufacturers have attempted to reduce hoistway or elevator shaft overhead dimensions and pit depth while maintaining safety features. Mechanics currently go to the top of car, or on top thereof, or in the pit, for inspection or maintenance activity of various components of an elevator car system. Thus, safety spaces or volumes are employed within the elevator shaft to protect a mechanic in the event of an emergency and thus require increased overhead and pit dimensions.

Further advancements and designs have attempted to completely eliminate the need for a mechanic to enter the hoistway, thus improving safety. An advantage of eliminating the need for entering the hoistway is that the traditional large pit depths and/or overhead spaces may be reduced such that very small pit depths/overhead clearances may be employed in such elevator systems.

Elevator cars typically include a toe guard or car apron situated beneath the elevator car door. The car apron is arranged to prevent persons from falling into an elevator shaft if the elevator car is not located at a landing and the landing doors are opened. The car apron is typically rigid and has a nominal height of about 750 mm. A significant amount of clearance beneath the elevator car is required to avoid contact between the car apron and the bottom of the elevator shaft when the elevator car is situated at a lowest landing. Such contact could cause significant damage to the car apron due to the rigid and fixed nature of the car apron. Accordingly, retractable car aprons have been proposed to address the above issues for systems employing small pit depths. However, improved systems may be advantageous.

BRIEF SUMMARY

According to some embodiments, elevator systems are provided. The elevator systems include an elevator car movable along an elevator shaft, the shaft having a pit floor and a shaft top, the elevator car having a car door sill, a car door lock arranged to enable opening of elevator car doors by a landing door lock mechanism when the elevator car is located at a landing, and an elevator safety system. The elevator safety system includes a car door lock securing device arranged to prevent manual opening of the elevator car doors when in a first state and permits opening of the elevator car doors when in a second state and a car apron affixed to the car door sill and operable from a stowed state to a deployed state, wherein when the car apron transitions from the stowed state to the deployed state, the car door lock securing device is transitioned from the first state to the second state.

In addition to one or more of the features described above, or as an alternative, further embodiments may include that the elevator safety system is an electrical system.

In addition to one or more of the features described above, or as an alternative, further embodiments may include a control unit connected to the car door lock securing device and a switch positioned relative to the car apron, wherein when the car apron transitions from the stowed state to the deployed state, the switch is actuated to complete an electrical circuit to the control unit to transition the car door lock securing device from the first state to the second state.

In addition to one or more of the features described above, or as an alternative, further embodiments may include a securing mechanism that operably connects the control unit to the car door lock securing device.

In addition to one or more of the features described above, or as an alternative, further embodiments may include an electrical connector electrically connecting operation of the car apron to operation of the car door lock securing device.

In addition to one or more of the features described above, or as an alternative, further embodiments may include a power source.

In addition to one or more of the features described above, or as an alternative, further embodiments may include that the elevator safety system is a mechanical system.

In addition to one or more of the features described above, or as an alternative, further embodiments may include a mechanical actuator mechanically connecting operation of the car apron to operation of the car door lock securing device.

In addition to one or more of the features described above, or as an alternative, further embodiments may include that the car apron is a multi-element car apron that is deployable from the stowed state having a stowed length to the deployed state having a deployed length, wherein the deployed length is longer than the stowed length.

In addition to one or more of the features described above, or as an alternative, further embodiments may include that the car apron comprises a first apron element and a second apron element, wherein the second apron element is fixed to the car door sill and the first apron element is moveable relative to the second apron element.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited by the accompanying figures in which like reference numerals indicate similar elements.

DETAILED DESCRIPTION

Figure 1:
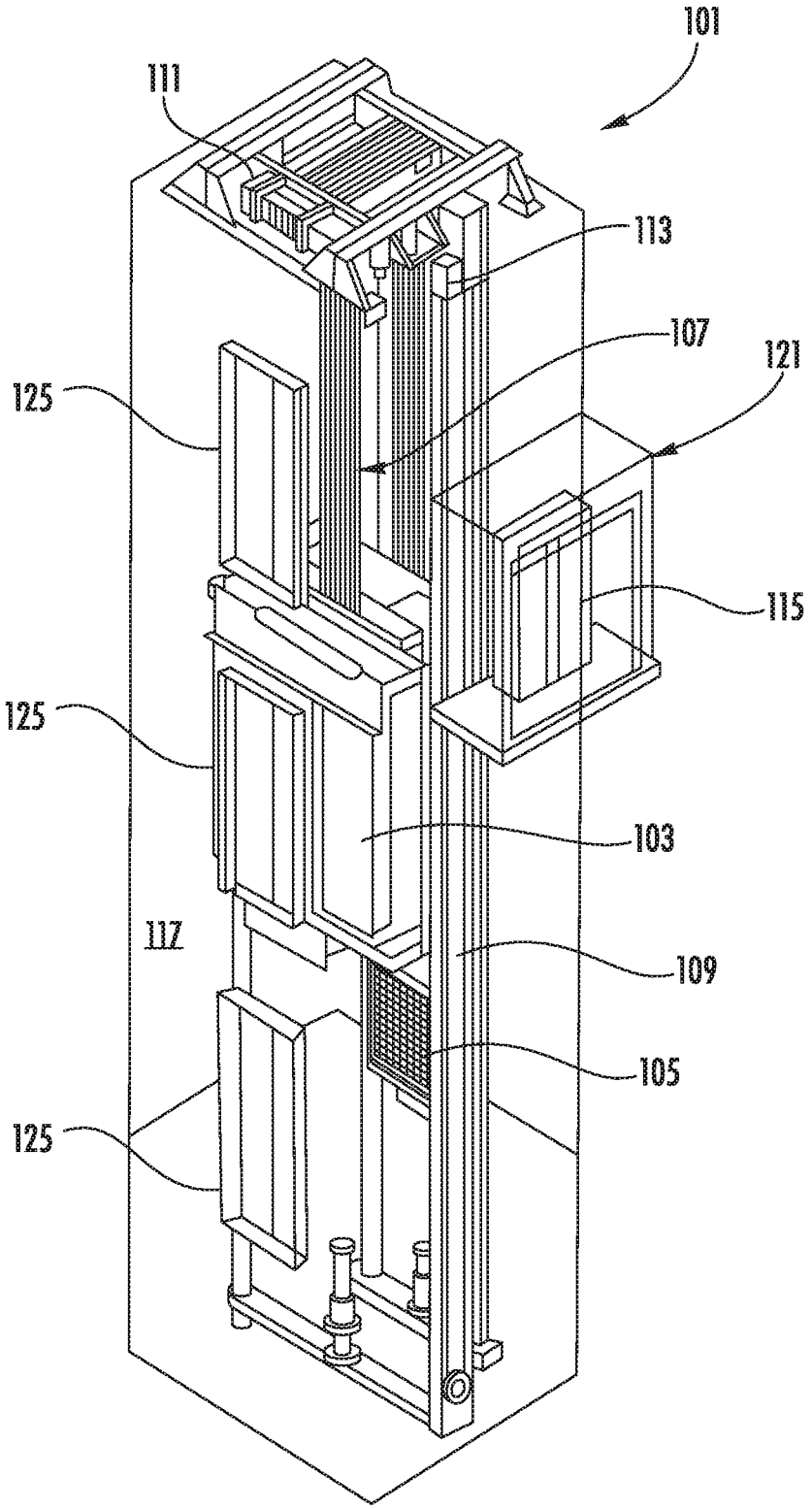
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter-weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
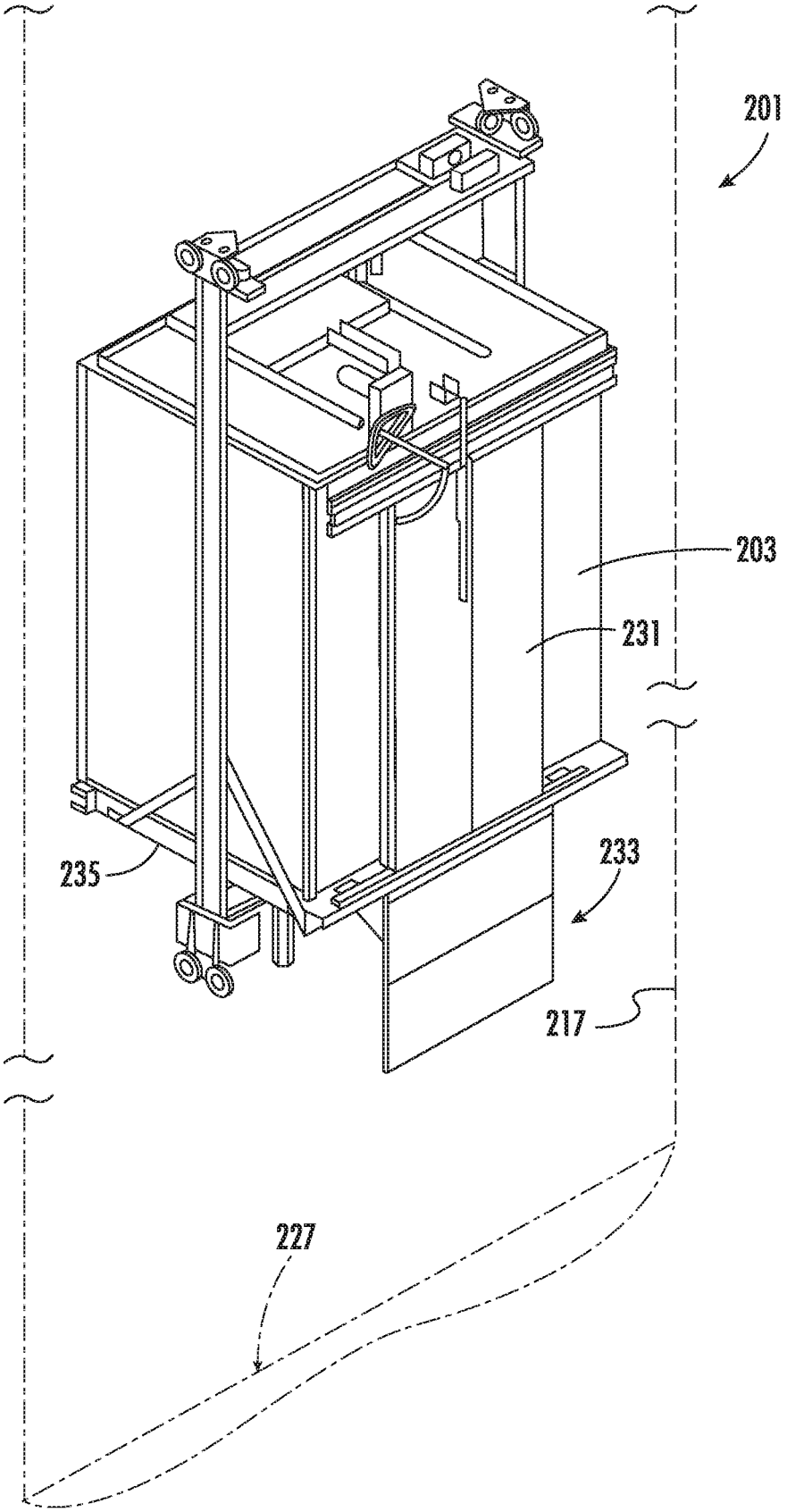
FIG. 2 is a schematic illustration of an elevator system that may employ embodiments of the present disclosure.

FIG. 2 is a schematic illustration of an elevator system 201 that can incorporate embodiments of the present disclosure. The elevator system 201 includes an elevator car 203 that is moveable within an elevator shaft 217. A pit floor 227 is shown at the bottom of the elevator shaft 217. The elevator car 203 includes elevator car doors 231 that open and close to allow ingress/egress to/from the elevator car 203 at one or more landings of the elevator system 201.

A car apron assembly 233 is provided on the elevator car 203 to cover the space between a bottom 235 of the elevator car 203 and an adjacent landing, when the elevator car 203 is in the proximity of the landing. If, for any reason, the landing doors (not shown) were to open before the elevator car 203 is properly aligned with the landing, the car apron assembly 233 is provided to at least partially block the open landing door. One function of the car apron assembly 233 is to prevent people from falling in the elevator shaft 217 during rescue operations when the elevator car door 231 is not aligned with a landing door.

However, the presence of the car apron assembly 233 impacts how close the elevator car 203 can get to the pit floor 227 of the elevator shaft 217. The example car apron assembly 233 of the present embodiment is collapsible or movable between an extended state (shown in FIG. 2) and a retracted state (not shown) that allows the elevator car 203 to descend closer to the pit floor 227 than may otherwise be possible to if the car apron assembly 233 remained in the extended state. That is, the dimensions of the car apron assembly 233 in the retracted state are significantly less than the dimensions of the car apron assembly 233 in an extended state.

Embodiments of the present disclosure are directed to car apron assemblies that are retractable or stowed until use is required, and may be manually deployed, and are configured to secure elevator car doors in a locked position until an authorized person needs to open the elevator car doors. Car aprons are used to prevent fall risks during situations where an elevator car is located at a position away from a landing (i.e., the elevator car doors are not aligned with a landing door, even with small offsets). When an elevator car is offset from a landing, and a landing door is opened (e.g., to rescue passengers within the elevator car), there may be a fall risk, and thus the car apron is deployable to block the opening below an elevator car and minimize or eliminate the fall risk. During a rescue operation, the elevator car doors must also be opened, and embodiments described herein are directed to linking operation of the car apron with the elevator car doors such that operation or deployment of the car apron enables operation of the elevator car doors.

In accordance with some embodiments of the present disclosure, low profile aprons are provided that are arranged to be deployed (e.g., manually) and when deployed enable operation of the elevator car doors. That is, in accordance with embodiments of the present disclosure, the car apron assemblies are arranged to manually deploy and operate or actuate a car door lock securing device or deterrent device to thus allow opening of the elevator car doors. In accordance with embodiments of the present disclosure, an elevator car door may be locked except when at a landing door, with the landing door mechanism configured to unlock the elevator car doors. However, when the elevator car is located between landings or offset from a landing, the elevator car doors are prevented from being opened due to a car door lock securing device or deterrent device. However, during a rescue operation, an authorized person (e.g., rescuer, emergency personnel, mechanics, etc.) may need to open a car door to rescue passengers on the elevator car. Thus, in accordance with some embodiments, the authorized person may open a landing door and manually deploy a car apron. When the car apron is deployed, the car door lock securing device is enabled to be operated and, thus, the elevator car doors may be opened. The connection between the car apron and the car door lock securing device may be mechanical, electrical, or electromechanical.

Figure 3:
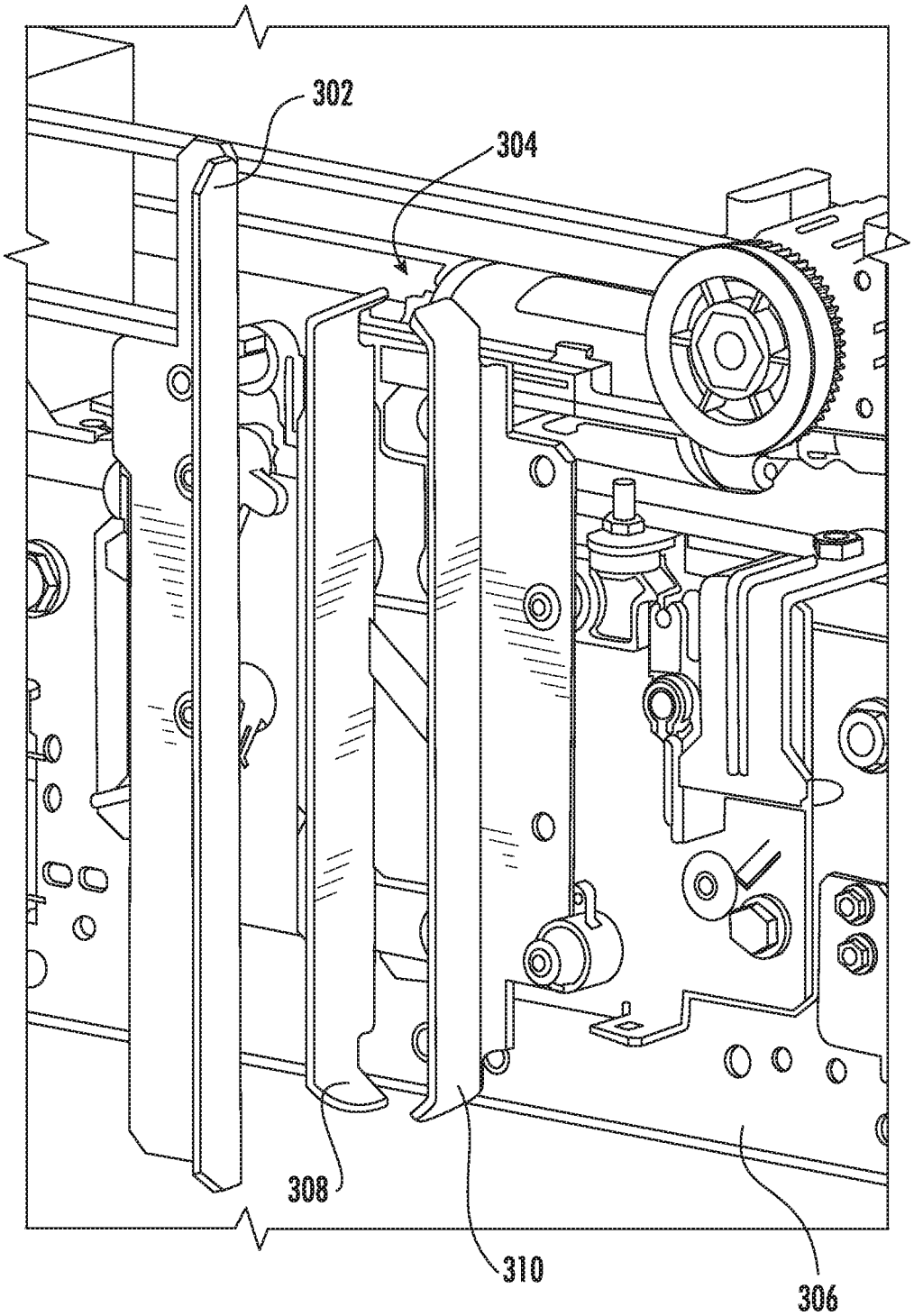
FIG. 3 is a schematic illustration of a car door lock securing device of an elevator safety system in accordance with an embodiment of the present disclosure.

Turning now to FIG. 3, a portion of an elevator safety system 300 in accordance with an embodiment of the present disclosure is shown. In this illustration, the car apron is not shown, but rather, FIG. 3 is illustrative of a car door lock securing device 302 that is arranged to block operation of a car door lock 304. The car door lock 304 and the car door lock securing device 302 are mounted to a car door lintel 306. In this illustrative embodiment, the car door lock 304 includes a first blade 308 and a second blade 310. In operation, the first blade 308 may be operable to move away from the second blade 310, such as when engaged by a landing door locking mechanism, and thus operation of elevator car doors may be performed. However, the car door lock securing device 302 is arranged to block movement of the first blade 308 when the elevator car is not located at a landing and the car door lock 304 is not engageable by a landing door locking mechanism.

The car door lock securing device 302 of the present disclosure is moveable from a first position that blocks operation of the car door lock 304 and a second position that allows for operation of the car door lock 304. During normal operation of the elevator car, the car door lock securing device 302 does not prevent operation of the landing door lock 304 when the elevator car is aligned with a landing and a landing door locking mechanism is engageable with the car door lock 304. However, when the elevator car moves away from the landing, the car door lock securing device 302 prevents operation of the car door lock 304. Prevention of operation of the car door lock 304 may be achieved by the car door lock securing device 302 or a portion thereof preventing movement of the first blade 308. Thus, the car door lock securing device 302 provides a mechanical block to prevent improper operation of the car door lock 304.

However, when a rescue operation is attempted and a car apron is deployed, as described below, the car door lock securing device 302 may be actuated or moved to allow for full operation of the car door lock 304, even when the elevator car is not located at a landing door. That is, operation of the car apron allows for operation of the car door lock 304 by actuating or moving the car door lock securing device 302.

Figure 4A:
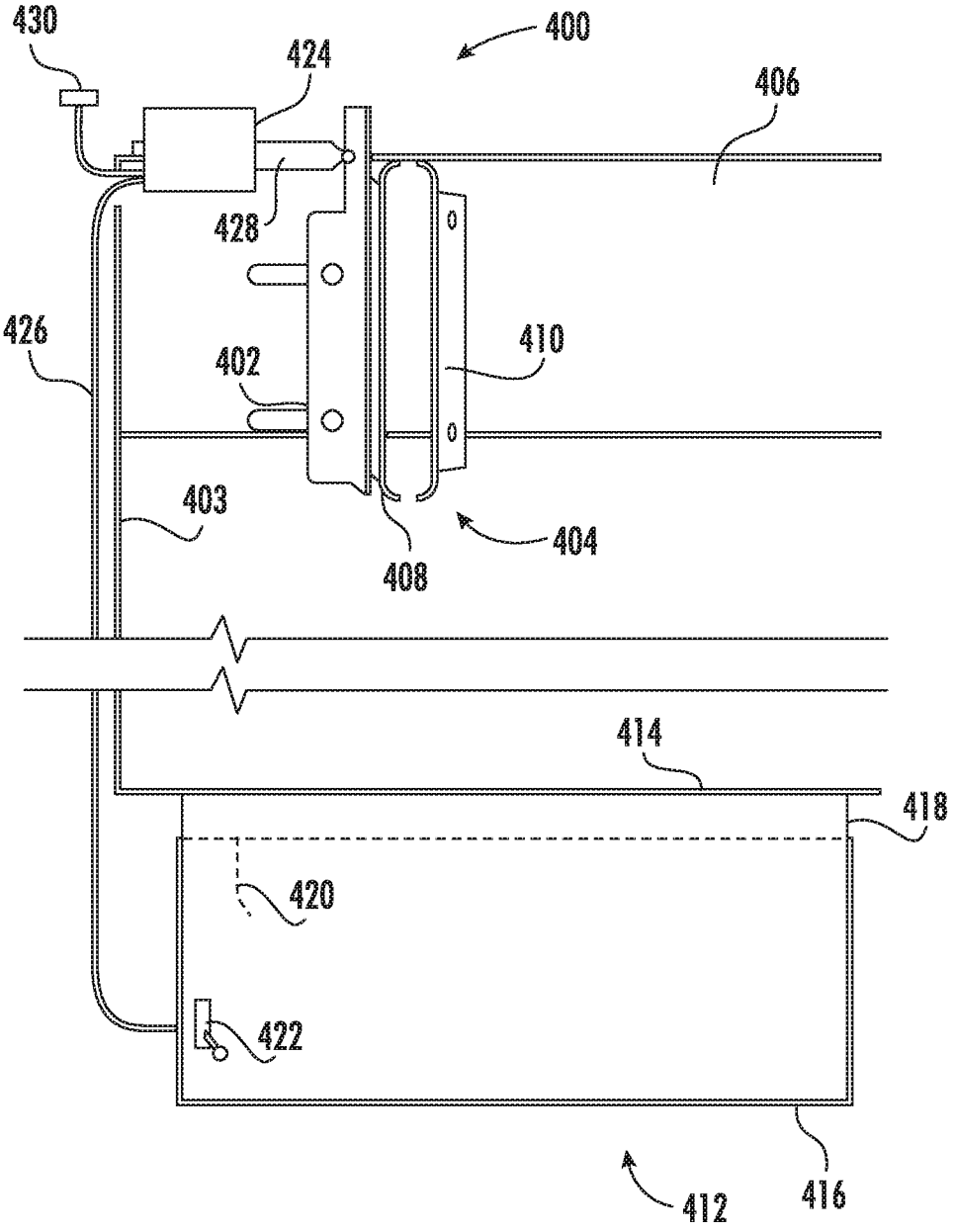
FIG. 4A is a schematic illustration of an elevator safety system in accordance with an embodiment of the present disclosure in a first state.
Figure 4B:
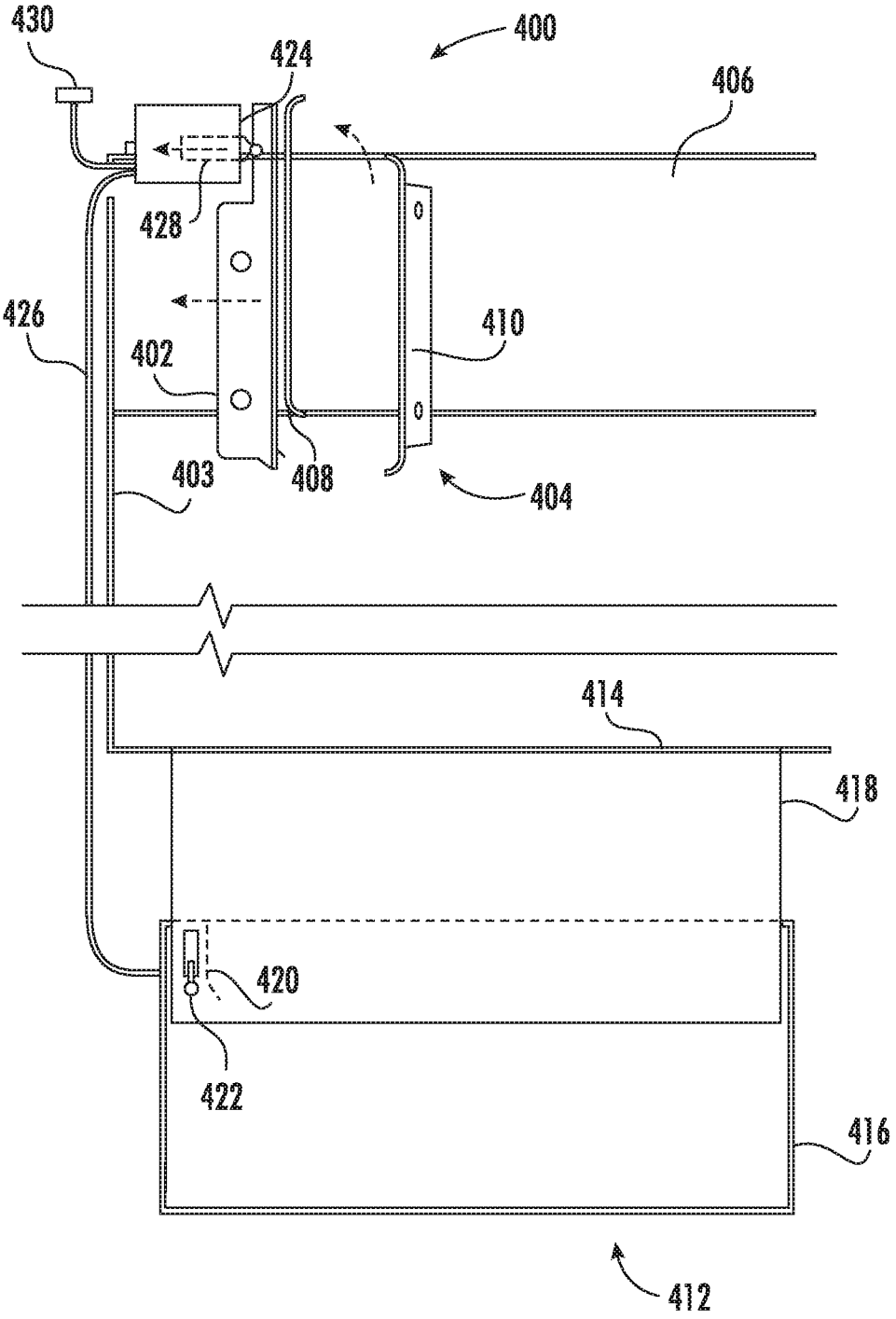
FIG. 4B is a schematic illustration of the system of FIG. 4A shown in a second state.

Turning now to FIGS. 4A-4B, schematic illustrations of an elevator safety system 400 in accordance with an embodiment of the present disclosure are shown. FIG. 4A illustrates the elevator safety system 400 in a first state (e.g., normal operation of the elevator system). FIG. 4B illustrates the elevator safety system 400 in a second state (e.g., a rescue operation). In the first state shown in FIG. 4A, a car apron 412 is shown in a stowed state and in the second state shown in FIG. 4B, the car apron 412 is shown in a deployed state.

The elevator safety system 400 of this embodiment is an electrical system that links operation of a car door lock 404 with operation of the car apron 412 that is attached to a sill 414 of an elevator car 403. The car door lock 404 is mounted to a car door lintel 406. The car door lock 404 includes a first blade 408 and a second blade 410, as described above. Operation of the car door lock 404 is prevented from manual operation due to a car door lock securing device 402, which in this embodiment prevents movement or operation of the first blade 408 of the car door lock 404.

The car apron 412 of this embodiment includes a first apron element 416 and a second apron element 418. The first apron element 416 is moveable relative to the second apron element 418, with the second apron element 418 fixedly connected to the sill 414 of the elevator car 403. The first apron element 416 includes an actuation member 420 that is configured to control operation of the car door lock securing device 402 through actuation of a switch 422.

The switch 422 is electrically connected to a control unit 424 by an electrical connector 426 that extends from the car apron 412 to the control unit 424. The control unit 424 is operably connected to the car door lock securing device 402 by a securing mechanism 428, such as a plunger, piston, linking bar/rod, etc. The control unit 424 is electrically connected to a power supply 430. In operation, when the switch 422 is operated by the actuation member 420 of the car apron 412, an electrical circuit may be completed, and the control unit 424 may retract the securing mechanism 428 which in turn will move the car door lock securing device 402 (as shown in FIG. 4B).

As shown in FIG. 4B, the first apron element 416 has moved relative to the second apron element 418, and the actuation member 420 has contacted and actuated the switch 422. That is, FIG. 4B illustrates the apron 412 in the deployed state such that an opening at a landing door may be covered by the apron 412 and prevent risk of falling into an elevator shaft. The car apron 412 may be operated from the stowed state (FIG. 4A) to the deployed state (FIG. 4B) by manual operation, such as use of a safety key or other control element, as will be appreciated by those of skill in the art. The first apron element 416 may fall or otherwise deploy by operation of gravity (or may be manually deployed). As the first apron element 416 moves downward relative to the second apron element 418, the actuation member 420 will contact and actuate the switch 422, thus triggering operation of the control unit 424. When the control unit 424 is operated, the car door lock securing device 402 will move away from the car door lock 404 and enable movement of the first blade 408 of the car door lock 404 to allow opening of an elevator car door.

Figure 5B:
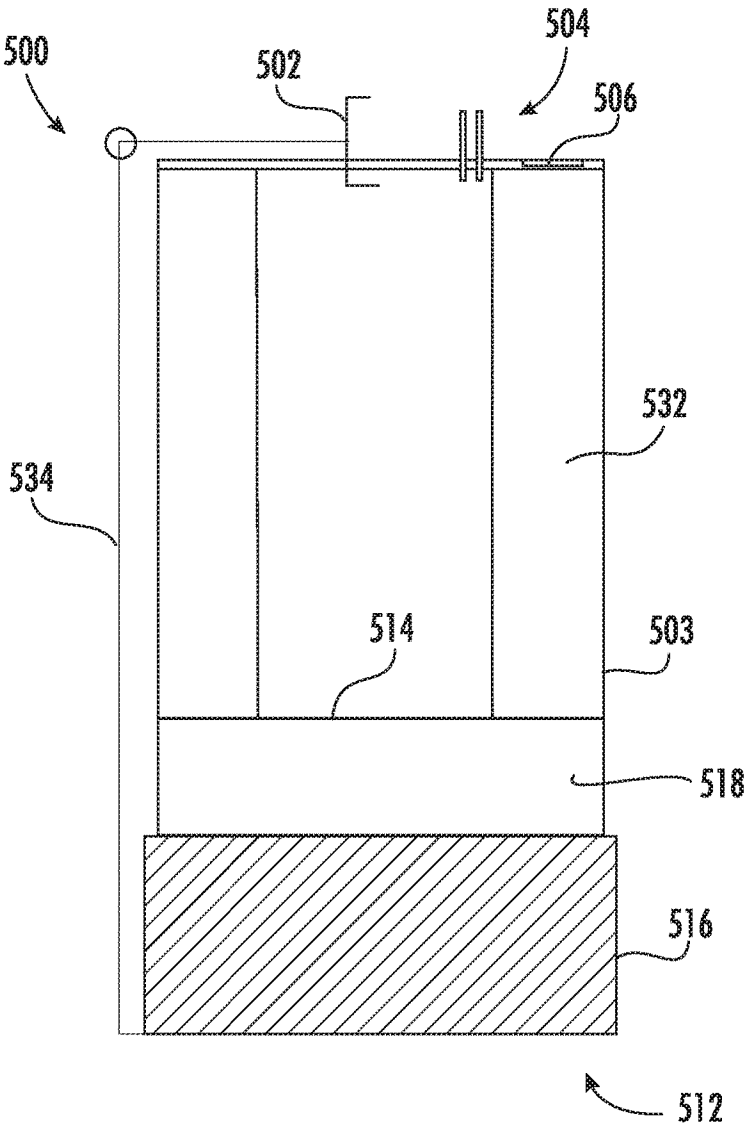
FIG. 5B is a schematic illustration of the system of FIG. 5A shown in a second state.
Figure 5A:
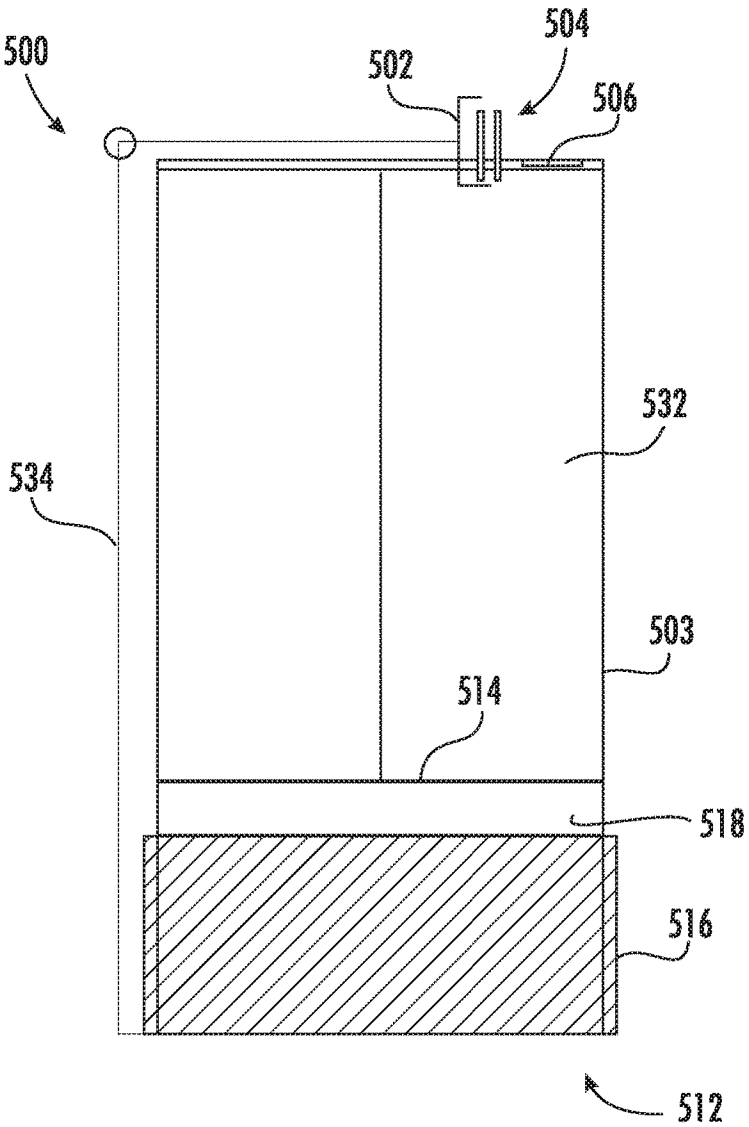
FIG. 5A is a schematic illustration of an elevator safety system in accordance with an embodiment of the present disclosure in a first state.

Turning now to FIGS. 5A-5B, schematic illustrations of an elevator safety system 500 in accordance with an embodiment of the present disclosure are shown. FIG. 5A illustrates the elevator safety system 500 in a first state (e.g., normal operation of the elevator system). FIG. 5B illustrates the elevator safety system 500 in a second state (e.g., a rescue operation). In the first state shown in FIG. 5A, a car apron 512 is shown in a stowed state and in the second state shown in FIG. 5B, the car apron 512 is shown in a deployed state.

The elevator safety system 500 of this embodiment is a mechanical system that links operation of a car door lock 504 with operation of the car apron 512 that is attached to a sill 514 of an elevator car 503. The car door lock 504 is mounted to a car door lintel 506 and is operable to control operation of an elevator car door 532. The car door lock 504 includes a blade configuration, as described above. Operation of the car door lock 504 is prevented from manual operation due to a car door lock securing device 502 similar to that described above.

The car apron 512 of this embodiment includes a first apron element 516 and a second apron element 518. The first apron element 516 is moveable relative to the second apron element 518, with the second apron element 518 fixedly connected to the sill 514 of the elevator car 503. The first apron element 516 of this embodiment is physically connected or attached to a mechanical actuator 534. The mechanical actuator 534 may be a cord or cable, or may be a rod-like arrangement with various parts to enable operation described herein. For example, as shown in FIGS. 5A-5B, as the first apron element 516 moves downward, the mechanical actuator 534 will cause the car door lock securing device 502 to move away from the car door lock 504 and thus allow operation thereof. As shown in FIG. 5B, the elevator car doors 532 are opened to allow for passengers to exit the elevator car 503.

Figure 6A:
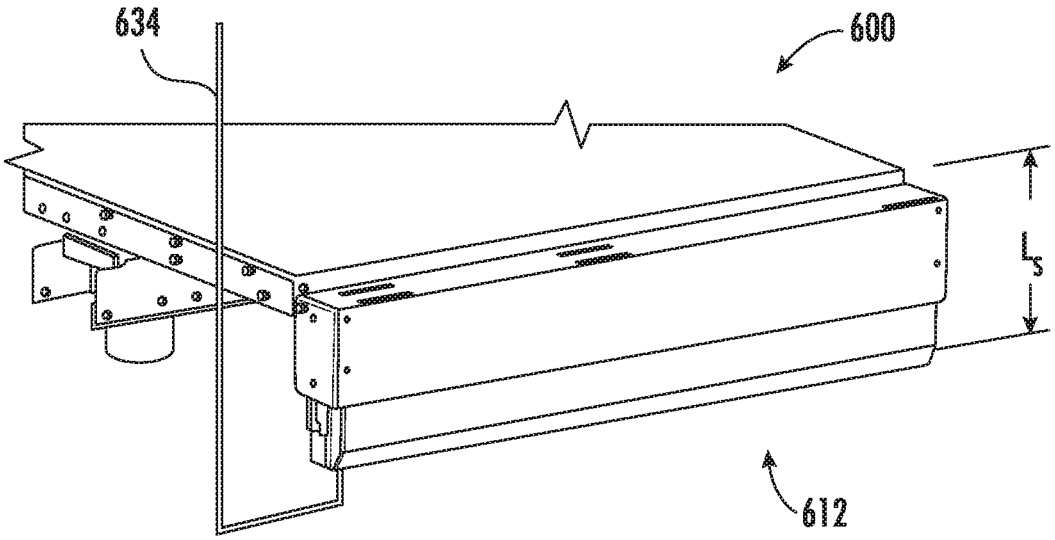
FIG. 6A is a schematic illustration of a car apron of an elevator safety system in accordance with an embodiment of the present disclosure in a stowed state.
Figure 6B:
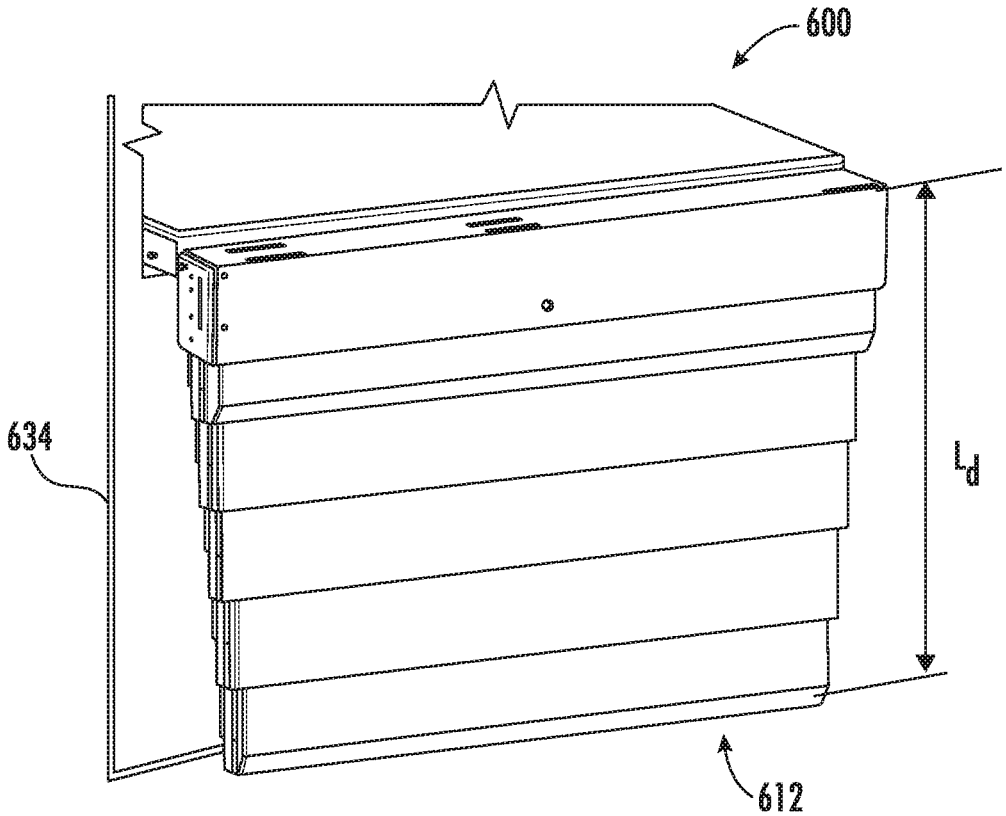
FIG. 6B is a schematic illustration of the car apron of FIG. 6A shown in a deployed state.

Turning now to FIGS. 6A-6B, schematic illustrations of a car apron 612 of elevator safety system 600 in accordance with an embodiment of the present disclosure are shown. It is noted that the above described embodiments/illustrations included only two apron elements. However, as shown in FIGS. 6A-6B, such embodiments are not the only arrangement that may be employed in accordance with the present disclosure. For example, as shown in FIGS. 6A-6B, a multi-element car apron 612 is shown, with the car apron 612 having a telescoping arrangement. The multi-element car apron 612 can be arranged as part of an electric or mechanical elevator safety system. As schematically shown in this illustration, the elevator safety system 600 is a mechanical system with a mechanical actuator 634 extending from the car apron 612 to a car door lock securing device, as shown and described above.

FIGS. 6A-6B are also illustrative of the low profile aspect of the car apron 612. FIG. 6A represents a stowed state of the car apron 612 and FIG. 6B represents a deployed state of the car apron 612. The stowed state is employed during normal operation of an elevator system and the deployed state is employed during a rescue operation or when landing doors are opened and the elevator car is offset from the landing. In the stowed state, the car apron 612 has a stowed length $L_s$ and in the deployed state the car apron has a deployed length $L_d$. As shown, the deployed length $L_d$ is longer than the stowed length $L_s$. The low profile achieved through use of the stowable/collapsible car apron 612 enables use in elevator systems with low to minimal elevator shaft pits. In one non-limiting example, the stowed length $L_s$ may be between 0-350 mm and the deployed length $L_d$ may be any dimension greater than the stowed length $L_s$, and in one non-limiting example, may be between 500-5000 mm.

Although shown and described herein with the car door lock located at the top of the elevator car doors, those of skill in the art will appreciate that such position is not to be limiting. For example, some elevator cars may be configured with door locks that are located at the bottom of the elevator car doors/elevator car, but such position does not limit application of embodiments described herein. Further, the positioning of the various elements of the elevator safety systems shown and described here is provided for example and illustrative purposes and is not intended to be limiting in the location of such components or parts.

Advantageously, embodiments described herein provide elevator safety systems that tie operation of elevator car doors to deployment of a car apron. Thus, advantageously, to enable opening of elevator car doors that are not positioned proximate a landing door, the car apron must be deployed (and provide the associated safety) to enable operation of the elevator car doors. Further, advantageously, car aprons in accordance with the present disclosure may have a stowed state with a minimal profile and thus small elevator pits can be employed. However, when a landing door is opened to gain access to an elevator shaft or elevator car, and the car is offset and adjacent the given landing, the car apron must be deployed to enable opening of elevator car doors. Thus, improved safety may be achieved through the use of car apron assemblies of the present disclosure.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system comprising:

an elevator car movable along an elevator shaft, the shaft having a pit floor and a shaft top, the elevator car having a car door sill;

a car door lock arranged to enable opening of elevator car doors by a landing door lock mechanism when the elevator car is located at a landing; and an elevator safety system comprising:

a car door lock securing device arranged to prevent manual opening of the elevator car doors when in a first state and permits opening of the elevator car doors when in a second state; and a car apron affixed to the car door sill and operable from a stowed state to a deployed state, wherein when the car apron transitions from the stowed state to the deployed state, the car door lock securing device is transitioned from the first state to the second state.

2. The elevator system of claim 1, wherein the elevator safety system is an electrical system.

3. The elevator system of claim 2, further comprising an electrical connector electrically connecting operation of the car apron to operation of the car door lock securing device.

4. The elevator system of claim 2, further comprising a power source.

5. The elevator system of claim 2, wherein the car apron is a multi-element car apron that is deployable from the stowed state having a stowed length to the deployed state having a deployed length, wherein the deployed length is longer than the stowed length.

6. The elevator system of claim 2, wherein the car apron comprises a first apron element and a second apron element, wherein the second apron element is fixed to the car door sill and the first apron element is moveable relative to the second apron element.

7. The elevator system of claim 2, further comprising:

a control unit connected to the car door lock securing device; and a switch positioned relative to the car apron, wherein when the car apron transitions from the stowed state to the deployed state, the switch is actuated to complete an electrical circuit to the control unit to transition the car door lock securing device from the first state to the second state.

8. The elevator system of claim 7, further comprising an electrical connector electrically connecting operation of the car apron to operation of the car door lock securing device.

9. The elevator system of claim 7, further comprising a securing mechanism that operably connects the control unit to the car door lock securing device.

10. The elevator system of claim 9, further comprising an electrical connector electrically connecting operation of the car apron to operation of the car door lock securing device.

11. The elevator system of claim 1, wherein the elevator safety system is a mechanical system.

12. The elevator system of claim 11, further comprising a mechanical actuator mechanically connecting operation of the car apron to operation of the car door lock securing device.

13. The elevator system of claim 11, wherein the car apron is a multi-element car apron that is deployable from the stowed state having a stowed length to the deployed state having a deployed length, wherein the deployed length is longer than the stowed length.

14. The elevator system of claim 11, wherein the car apron comprises a first apron element and a second apron element, wherein the second apron element is fixed to the car door sill and the first apron element is moveable relative to the second apron element.

15. The elevator system of claim 1, wherein the car apron is a multi-element car apron that is deployable from the stowed state having a stowed length to the deployed state having a deployed length, wherein the deployed length is longer than the stowed length.

16. The elevator system of claim 1, wherein the car apron comprises a first apron element and a second apron element, wherein the second apron element is fixed to the car door sill and the first apron element is moveable relative to the second apron element.

* * * * *